US011492826B2

(12) United States Patent
Rosales

(10) Patent No.: US 11,492,826 B2
(45) Date of Patent: Nov. 8, 2022

(54) MOTOR VEHICLE LOCK

(71) Applicant: Brose Schließsysteme GmbH & Co. Kommanditgesellschaft, Wuppertal, Wuppertal (DE)

(72) Inventor: David Rosales, Rochester Hills, MI (US)

(73) Assignee: BROSE SCHLIESSSYSTEME GMBH & CO. KOMMANDITGESELLSCHAFT, WUPPERTAL, Wuppertal (DE)

( * ) Notice: Subject to any disclaimer, the term of this patent is extended or adjusted under 35 U.S.C. 154(b) by 420 days.

(21) Appl. No.: 16/407,691

(22) Filed: May 9, 2019

(65) Prior Publication Data

US 2020/0354998 A1 Nov. 12, 2020

(51) Int. Cl.
*E05B 85/26* (2014.01)
*E05B 83/36* (2014.01)

(52) U.S. Cl.
CPC ..... *E05B 85/26* (2013.01); *E05B 83/36* (2013.01)

(58) Field of Classification Search
CPC ..... E05B 85/20; E05B 85/24; E05B 85/243; E05B 85/26; E05B 83/36; E05B 81/20; Y10T 292/1082; Y10T 292/1047; Y10S 292/23
See application file for complete search history.

(56) References Cited

U.S. PATENT DOCUMENTS 3,331,624 A * 7/1967 Pugh ..... E05B 85/243 292/216
3,692,343 A * 9/1972 Meyer ..... E05B 85/243 292/216
5,273,325 A * 12/1993 Zimmermann ..... E05B 81/22 292/216
5,979,951 A * 11/1999 Shimura ..... E05B 85/26 292/216
2017/0350173 A1* 12/2017 Gumbo ..... E05B 85/26

FOREIGN PATENT DOCUMENTS

DE 1553470 A1 * 8/1970 ..... E05B 85/243
DE 102009037037 A1 * 2/2011 ..... E05B 85/26
DE 102017002045 A1 * 9/2018 ..... E05B 85/26
DE 102018120435 A1 * 2/2020 ..... E05B 85/26
DE 102018126288 A1 * 4/2020 ..... E05B 85/26
EP 2803796 A2 11/2014
WO WO-2019076400 A1 * 4/2019 ..... E05B 85/26

* cited by examiner

*Primary Examiner* — Alyson M Merlino
(74) *Attorney, Agent, or Firm* — Brooks Kushman P.C.

(57) ABSTRACT

A motor vehicle lock including a detent mechanism with a catch and a pawl arrangement. The catch may be pivoted between an open position, a primary closed position and a secondary closed position, which secondary closed position is situated between the open position and the primary closed position. The pawl arrangement, in a blocking state, blocks the catch in the primary closed position and in the secondary closed position, and may be moved into a release state to release the catch. The pawl arrangement comprises a primary pawl, in the blocking state, in blocking engagement with the catch, and a secondary pawl in blocking engagement with the primary pawl. The blocking state, the secondary pawl may be lifted to release the primary pawl, such that the primary pawl may be lifted to release the catch. The motor vehicle lock comprises an actuation lever, that may lift the secondary pawl.

19 Claims, 4 Drawing Sheets

MOTOR VEHICLE LOCK

TECHNICAL FIELD

The present disclosure relates to a motor vehicle lock.

BACKGROUND

Vehicles may include one or more closures, such as, hatches, doors, tailgates, or liftgates. Certain closures may close and open automatically, e.g. without the assistance of an operator. Vehicles generally include a seal or other type of weather proofing barrier positioned between the closure and the vehicle body to mitigate external elements such as moisture, precipitation, dirt, debris, and noise from entering the interior of the vehicle. The force applied to the closure, by a latch for example, must be sufficient to overcome pressure associated with the closure and the seal. Also, the vehicle may be equipped with a device or mechanism that may automatically release the latch, so the closure may move to an open position.

SUMMARY

The present disclosure may provide a motor vehicle lock with a catch and a pawl arrangement, which in any lock state may be opened with low opening forces.

First of all, it has been realized that the two-pawl-concept known from the state of the art may not be applied to both of the closed positions of the catch without introducing a mechanism, which prevents the catch from being unintentionally blocked during its closing movement. This unintentional blocking of the closing movement of the catch may be an issue, when the design of the detent mechanism requires a certain lifting movement of the pawl during the movement of the catch from the secondary closed position into the primary closed position.

In order to allow the application of the two-pawl-concept with a maximum degree of constructional flexibility, it is proposed that during a closing movement of the catch from the open position into its closing direction, the catch actuates the actuation lever to lift the secondary pawl out of blocking engagement from the primary pawl.

With one or more of the proposed solutions, it is guaranteed that the two pawls do not hinder the closing movement of the catch. The proposed solution is particularly simple in construction, as the actuation lever is used for lifting the secondary pawl out of blocking engagement from the primary pawl during the closing movement. As the actuation lever is normally existing anyway in the motor vehicle lock in question, the constructional complexity for realizing the proposed solution is exceptionally low.

The above noted coupling between the two pawls and the catch may be realized by corresponding surfaces of those components.

In one or more embodiments, the primary pawl may be at least partly lifted, when the catch is being moved from the secondary closed position into the closing direction. With this, it may for example be realized that in both closed positions of the catch, in the blocking state, the primary pawl may be in one and the same position. This means that the blocking of the primary pawl by the secondary pawl may be realized identically for both closed positions of the catch.

As one example, it is clarified that the primary pawl is assigned an opening tendency as explained above irrespective of the catch being in the primary closed position or the secondary closed position. As noted above, this is the basis for realizing the low opening forces for both closed positions of the catch.

As one example, the section of closing movement, in which the proposed actuation of the actuation lever takes place, is specified. In further detail, the proposed actuation of the actuation lever takes place during the closing movement of the catch from the secondary closed position into the closing direction. This is may be realized by a driving surface of the catch driving a receiving surface of the actuation lever. This may provide for an exceptionally simple construction.

In order to allow the pawl arrangement to fall into the blocking state, when the catch reaches its primary closed position during the closing movement, the catch may release the actuation lever before the catch reaches its primary closed position. This synchronisation may providea safe interaction between the catch and the pawl arrangement.

In one or more embodiments, an additional coupling between the secondary pawl and the primary pawl is advantageous in view of a safe release of the catch during opening of the motor vehicle lock. A simple constructional solution may assign a driving surface to the secondary pawl, which may drive a receiving surface of the primary pawl, lifting the primary pawl out of blocking engagement from the catch.

A particularly compact overall arrangement may be achieved by the preferred embodiment according to one or more embodiments, that may provide a jaw like indentation in the primary pawl, into which indentation the secondary pawl enters with its blocking surface when the primary pawl is being lifted. This shuffling of the two pawls with each other may lead to an optimized utilisation of the available space within the motor vehicle lock.

In one or more embodiments, a motorized opening sequence for the motor vehicle lock may be provided. The motor vehicle lock may be assigned an opening drive which, due to the low opening forces, that may be configured as a low performance drive, which may lead to a compact and, in addition, to a cost effective arrangement.

BRIEF DESCRIPTION OF THE DRAWINGS

In the following, an embodiment of the invention is explained with respect to the drawings. In the drawings show FIG. 1 a motor vehicle with a proposed motor vehicle lock, FIG. 2 the motor vehicle lock according to FIG. 1 with the pawl arrangement in its blocking state and the catch in its secondary closed position, FIG. 3 the motor vehicle lock according to FIG. 1*a*) during the closing movement of the catch, with the catch between its secondary closed position and its primary closed position and *b*) after the closing movement has been finalized with the pawl arrangement in its blocking state and the catch in its primary closed position and FIG. 4 the motor vehicle lock according to FIG. 1*a*) during the opening sequence with the secondary pawl being lifted and the catch still in its primary closed position and *b*) after the opening sequence has been finalized with the pawl arrangement in its release state and the catch in its open position.

DETAILED DESCRIPTION

Figure 1:
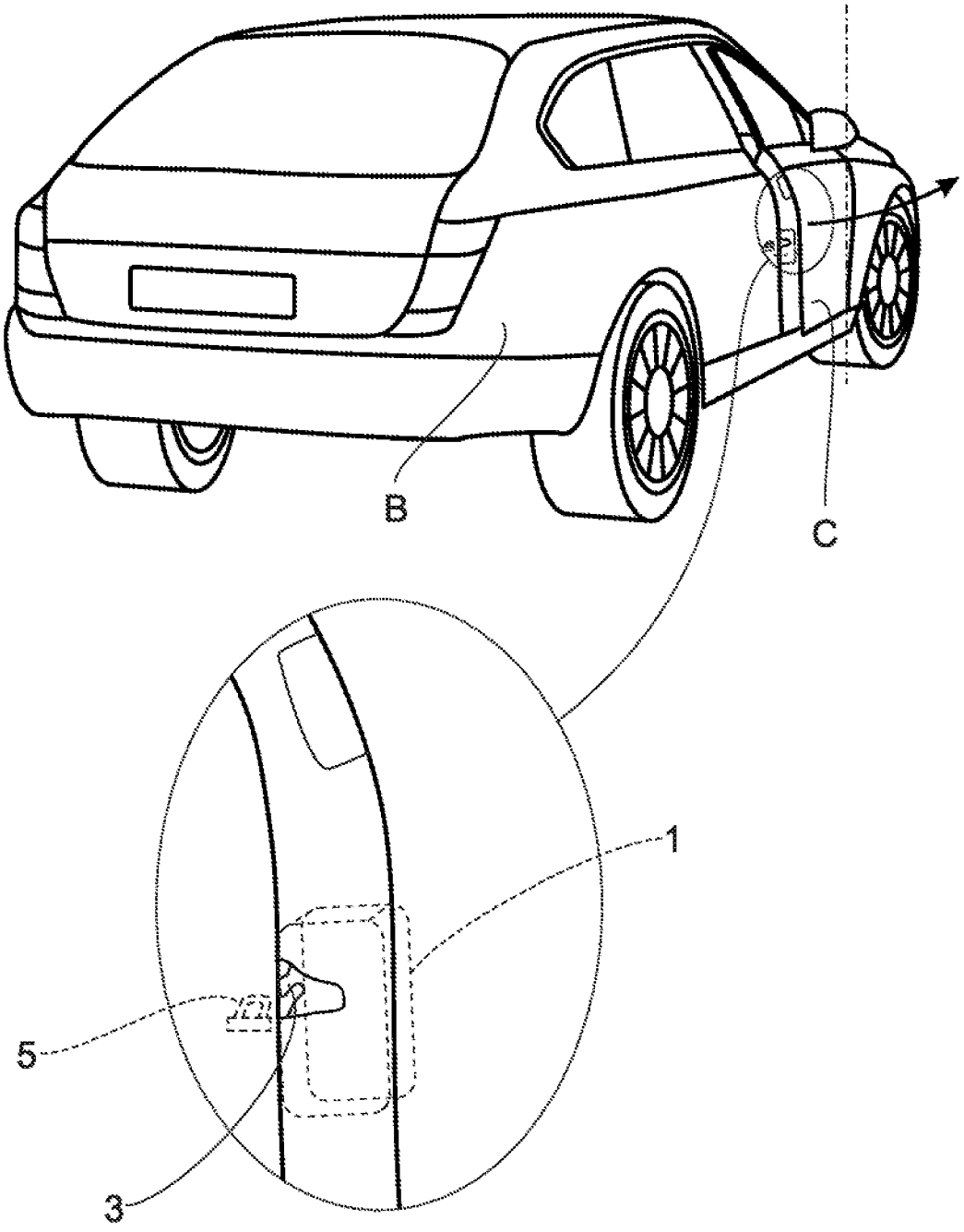

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

The motor vehicle lock in question may be assigned to any kind of closing element of a motor vehicle. Such a closing element of a motor vehicle may be a liftgate, a trunk lid, a back door, a front hood, a side door or the like. All those closing elements may be designed as pivotable or slideable closing elements.

The motor vehicle lock in question comprises a detent mechanism with a catch and a pawl arrangement, which may be opened with particularly low opening forces, even if high counter forces are present between the closing element and the motor vehicle body. Those counter forces are mainly being generated by compression of the seals of the closing element, when the closing element is transferred into its fully closed position.

The motor vehicle lock (EP 2 803 796 B1), which is the starting point of the invention, comprises a detent mechanism with a catch and a pawl arrangement, wherein in a blocking state of the pawl arrangement, with the catch being in the primary closed position, a primary pawl is in blocking engagement with the catch, while a secondary pawl is in blocking engagement with the primary pawl. In this situation, the primary pawl has an opening tendency, which means, that driving the catch into its open position causes the primary pawl to be driven into its lifting position via the blocking engagement between the catch and the primary pawl. This is why the secondary pawl is necessary to block any lifting of the primary pawl, while the pawl arrangement is in its blocking state.

As the catch, the primary pawl and the secondary pawl, in the blocking state of the pawl arrangement, add up to a gearing mechanism, such that low opening forces, which are necessary to lift the secondary pawl out of blocking engagement from the primary pawl, may be realized.

However, in the known solution, the above noted advantage of low opening forces, which normally are being transferred by an actuation lever onto the secondary pawl, is only realized for one of the two closed positions of the catch. This means that in one of the two closed positions of the catch, normally in the secondary closed position, the catch is being blocked by one pawl only, which is therefore assigned a closing tendency or no tendency at all. In certain situations this may lead to an undesirable increase of opening forces.

The proposed motor vehicle lock 1 may be assigned to any kind of closing element of a motor vehicle. Insofar as reference is made to the introductory part of the specification.

The motor vehicle lock 1 comprises a detent mechanism 2 with a catch 3 and a pawl arrangement 4, which interact with each other as will be explained.

The catch 3 may be pivoted between an open position (FIG. 4*b*)), a primary closed position (FIG. 3*b*) and a secondary closed position (FIG. 2), which secondary closed position is situated between the open position and the primary closed position. In each of the closed positions, the catch 3 is in holding engagement with a lock striker 5. Here, the motor vehicle lock 1 is arranged at a closing element C, while the lock striker 5 is arranged at the body B of the motor vehicle. A vice versa arrangement is possible.

The pawl arrangement 4 may be brought into a blocking state, in which the pawl arrangement 4 blocks the catch 3 in the respective closed position (FIG. 2, 3*b*)). Here, the pawl arrangement 4, when in its blocking state, blocks the catch 3 in its primary closed position as well as in its secondary closed position. The pawl arrangement 4 may also be moved into a release state, in which the pawl arrangement 4 releases the catch 3, such that the catch 3 may move into its open direction freely from the pawl arrangement 4. The pawl arrangement 4 comprises a primary pawl 6, which in the blocking state, is in blocking engagement with the catch 3. The pawl arrangement 4 further comprises a secondary pawl 7, which in the blocking state is in blocking engagement with the primary pawl 6, thereby indirectly blocking the catch 3, as will be explained later. The primary pawl 6 is pivotable around the primary pawl axis 6*a*, while the secondary pawl 7 is pivotable around the secondary pawl axis 7*a*.

In the blocking state, the secondary pawl 7 may be lifted to release the primary pawl 6. This allows the primary pawl 6 to be lifted to release the catch 3. This corresponds to the release state of the pawl arrangement 4.

The motor vehicle lock 1 may include an actuation lever 8, which actuation leads to the actuation lever 8 lifting the secondary pawl 7 with the result noted above.

In the drawings, the opening direction of the catch 3 is the clockwise direction, while the closing direction of the catch 3 is the counter-clockwise direction. The lifting direction of the pawls 6, 7 is the clockwise direction. The actuation direction of the actuation lever 8 is the clockwise direction.

Figure 3:
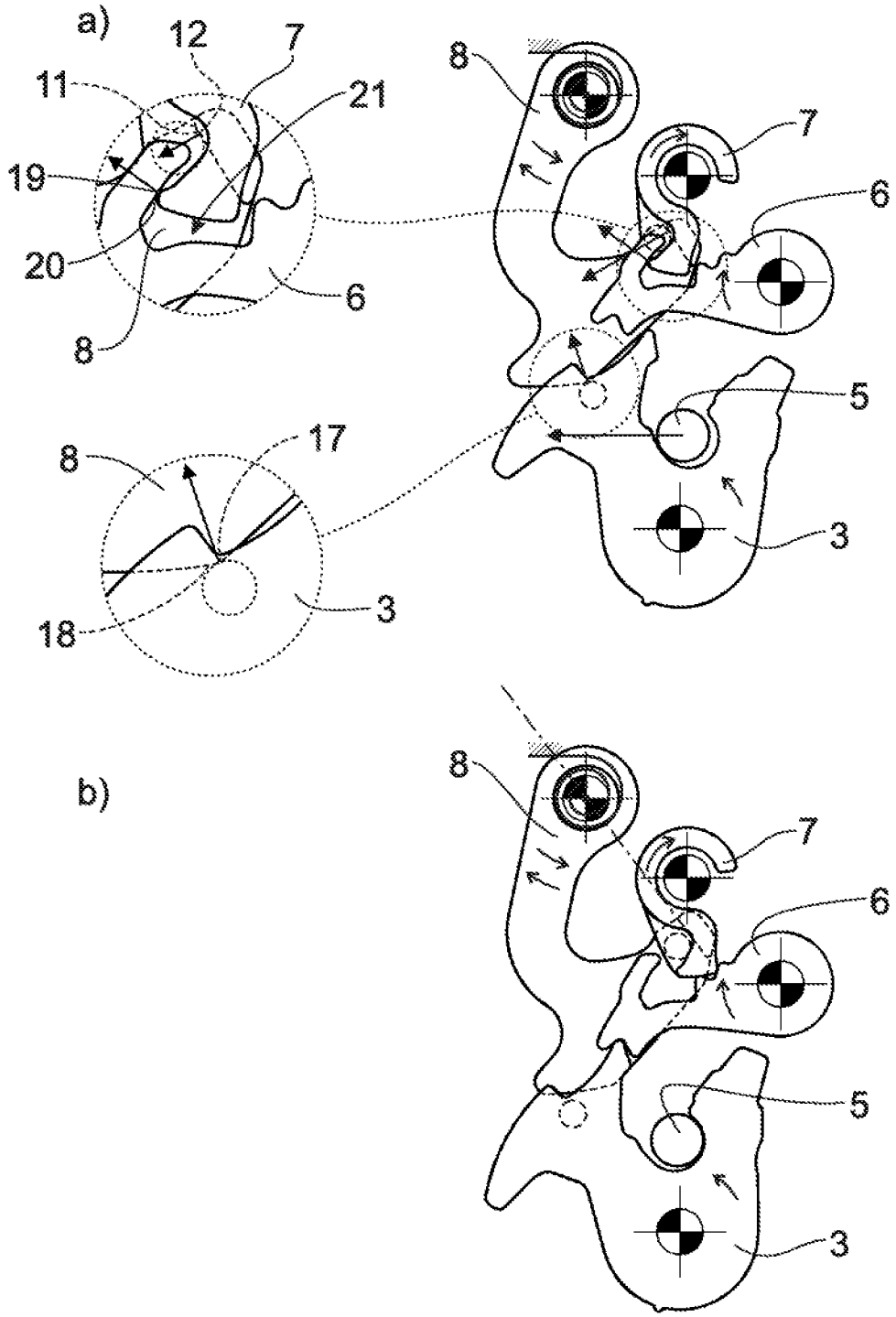

It is essential for the invention, that during a closing movement of the catch 3 from the open position (FIG. 4*b*)) into its closing direction, the catch 3 actuates the actuation lever 8 to lift the secondary pawl 7 out of blocking engagement from the primary pawl 6, which is shown in FIG. 3*a*) in a situation, in which the catch 3 is just before entering its primary closed position.

FIG. 3*a*) shows, that with the proposed solution, the catch 3 may be moved from the secondary closed position to the primary closed position without being hindered by the pawl arrangement 4. At the same time the proposed motor vehicle lock 1 allows blocking the catch 3 by a pawl arrangement 4 consisting of two pawls 6, 7, which generally allows the realization of low opening forces.

Figure 2:
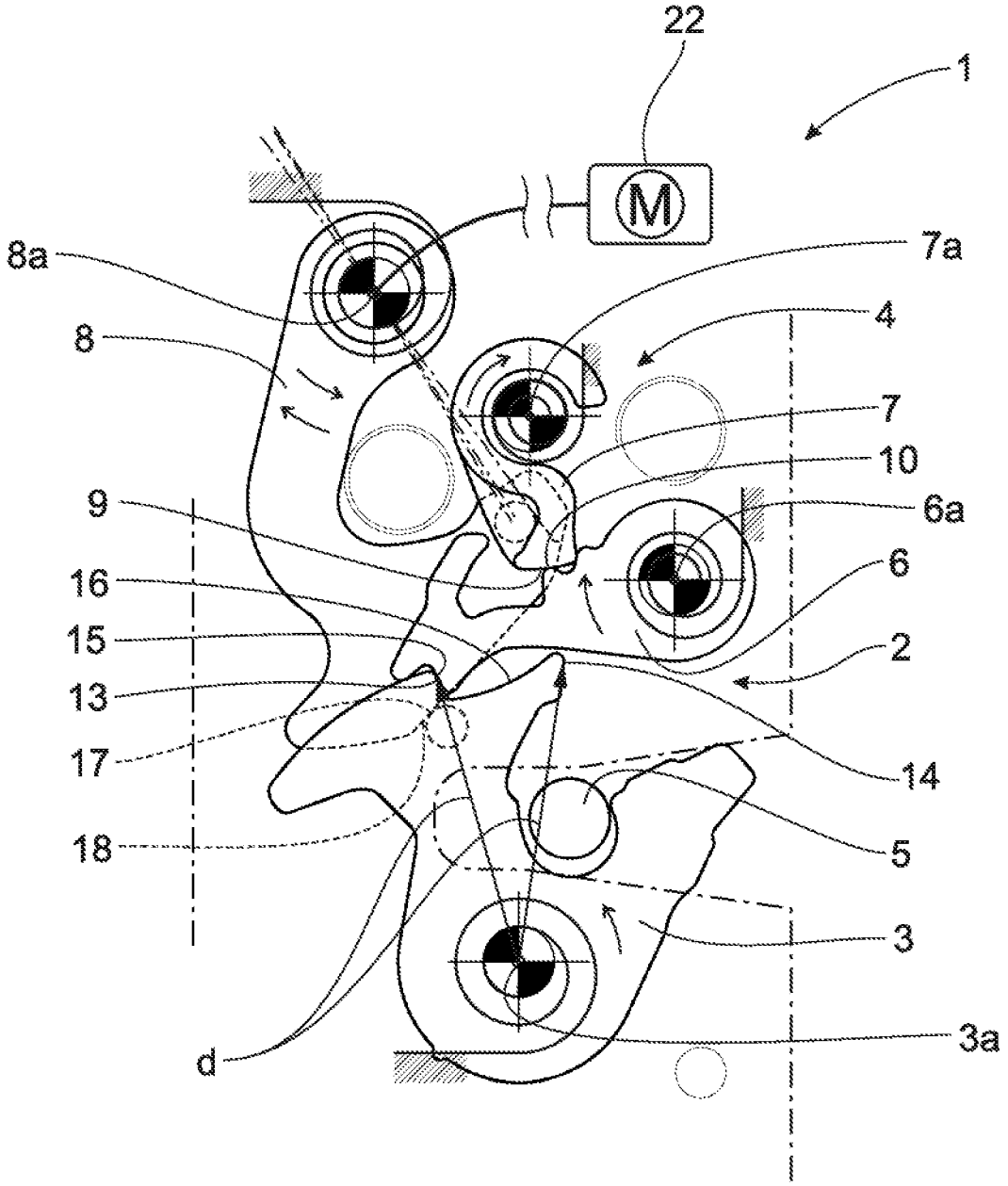

As may be seen in FIG. 2, 3*b*), a blocking surface 9 of the secondary pawl 7 blocks a counter blocking surface 10 of the primary pawl 6. The secondary pawl 7 has a closing tendency or no tendency at all, with respect to the engagement between the blocking surface 9 of the secondary pawl 7 and the counter blocking surface 10 of the secondary pawl 7. This means, that the primary pawl 6 cannot drive the secondary pawl 7 to be lifted.

In order to open the motor vehicle lock 1, the actuation lever 8 may be actuated. As noted above, this actuation goes along with pivoting the actuation lever 8 around the actuation lever axis 8*a* in the clockwise direction. During such actuation of the actuation lever 8, a driving surface 11 of the actuation lever 8 drives a receiving surface 12 of the secondary pawl 7, thereby lifting the secondary pawl 7 out of engagement from the primary pawl 6. This may be seen in FIG. 4*a*), in particular in the detailed view in FIG. 4*a*).

The primary pawl 6 may include a blocking surface 13, which in the blocking state, with the catch 3 being in the primary closed position, blocks a primary counter blocking surface 14 of the catch 3 (FIG. 2). With the catch 3 being in the secondary closed position, the blocking surface 13 of the primary pawl 6 blocks a secondary counter blocking surface 15 of the catch 3, as may be seen in FIG. 2.

It may also be expected from the presentation in FIG. 2, that the primary counter blocking surface 14 and the secondary counter blocking surface 15 are located in the same distance d from a pivot axis 3*a* of the catch 3. This means that realizing the blocking state of the pawl arrangement 4 may be identical for the primary closed position and the secondary closed position of the catch 3.

The realization of the above noted blocking of the catch 3 is particularly simple, if the position of the primary pawl 6 with the catch 3 being in the primary closed position is exactly the position of the primary pawl 6 with the catch 3 being in the secondary closed position. In the shown embodiment, this is the case, as may be seen from a combined look at FIG. 2 and FIG. 3*b*).

As may be seen in FIG. 3*a*), during at least part of the closing movement of the catch 3 from the secondary closed position into the closing direction, the primary pawl 6 is free from the catch 3, in particular from the outer edge 16 of the catch 3, due to the proposed actuation of the actuation lever 8, which actuation goes back on the interaction between the catch 3 and the actuation lever 8.

The primary pawl 6 may be assigned an opening tendency with the catch 3 in the primary closed position. As one example, the primary pawl 6 may be assigned an opening tendency with the catch 3 in the secondary closed position as well. This means, that in the respective closing position, the catch 3 may drive the primary pawl 6 to be lifted. For this, the blocking surface 13 of the primary pawl 6 on the one hand, and the primary counter blocking surface 14 and the secondary counter blocking surface 15 on the other hand, may be designed such that in the blocking state, driving the catch 3 into its opening direction drives the primary pawl 6 into its lifting direction, caused by the engagement between the blocking surface 13 of the primary pawl 6 and the respective counter blocking surface 14, 15 of the catch 3. This again means that in the blocking state of the pawl arrangement 4, lifting the secondary pawl 7 out of blocking engagement from the primary pawl 6, leads to the primary pawl 6 being driven into its lifting direction by the catch 3, which catch 3 urges into its opening direction due to spring forces or due to the compression of the seals assigned to the closing element C.

As noted above, during the closing movement of the catch 3 from the secondary closed position into the closing direction, the catch 3 actuates the actuation lever 8 to lift the secondary pawl 7 out of engagement from the primary pawl 6, as is shown in FIG. 3*a*). FIG. 3*a*) also shows, that during the closing movement of the catch 3 from the secondary closed position into the closing direction, a driving surface 17 of the catch 3 drives a receiving surface 18 of the actuation lever 8 and thereby actuates the actuation lever 8 to lift the secondary pawl 7 out of blocking engagement from the primary pawl 6. The detailed view in FIG. 3*a*) shows, that in this situation the driving surface 17 of the catch 3 drives the receiving surface 18 of the actuation lever 8, while the driving surface 11 of the actuation lever 8 drives the receiving surface 12 of the secondary pawl 7, lifting the secondary pawl out of blocking engagement from the primary pawl 6.

Subsequently, the above noted lifting of the secondary pawl 7 causes lifting of the primary pawl 6 out of blocking engagement from the catch 3, as is shown in FIG. 3*a*) as well. This is realized by a driving surface 19 of the secondary pawl 7 driving a receiving surface 20 of the primary pawl 6 out of blocking engagement from the catch 3.

Figure 4:
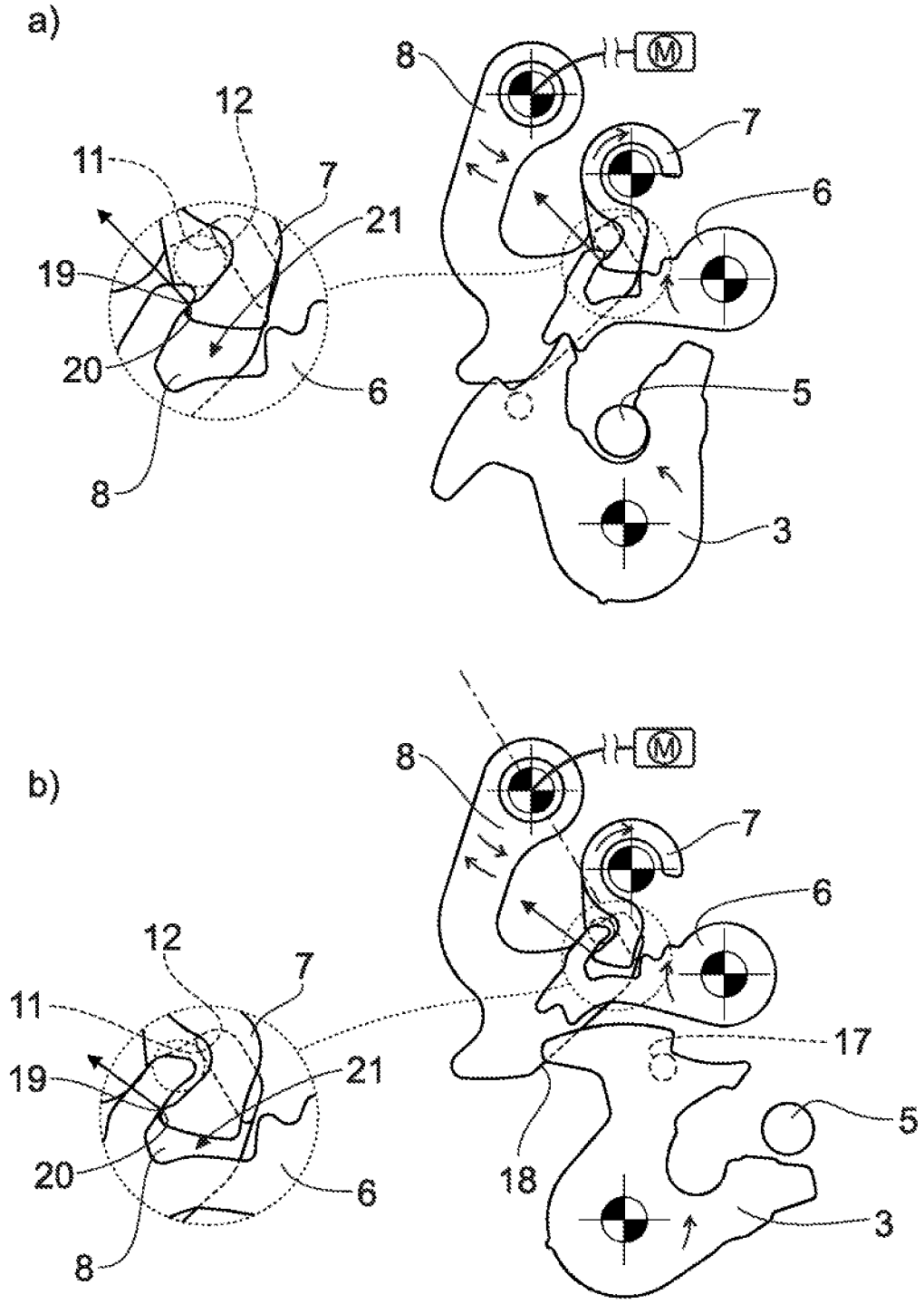

Further subsequently, during the ongoing closing movement of the catch 3 into the closing direction, the catch 3 releases the actuation lever 8, before the catch 3 reaches its primary closed position, as is shown in FIG. 4. Accordingly, when the catch 3 reaches its primary closed position or an overtravel position beyond the primary closed position, the primary pawl may fall into a blocking position shown in FIG. 4*a*). This release of the actuation lever 8 goes back on the receiving surface 18 of the actuation lever 8 being a guiding edge, which is curbed as to cause the release of the actuation lever 8 before the catch 3 reaches its primary position. In general terms, the driving surface 17 of the catch 3 and the receiving surface 18 of the actuation lever 8 add up to a sliding guide, which is designed to release the actuation lever 8 before the catch 3 reaches its primary position.

One or more embodiments may provide a compact structure, which is partly due to the following constructional concept: Here, the receiving surface 20 of the primary pawl 6 and the counter blocking surface 10 of the primary pawl 6 may be situated on opposite sides of a jaw like indentation 21 in the primary pawl 6, into which indentation 21 the secondary pawl 7 enters with its blocking surface 9, when the primary pawl 6 is being lifted as shown in FIG. 4*b*).

Here, an opening drive 22 is realized for motorized opening of the motor vehicle lock. The opening drive 22 actuates the actuation lever 8 for motorized opening of the motor vehicle lock 1 in an opening sequence. The opening sequence corresponds to the sequence of FIG. 4*a*) and FIG. 4*b*). FIG. 4*a*) shows, that the actuation lever has been actuated by the opening drive 22 in clockwise direction, such that the driving surface 11 of the actuation lever 8 drives the receiving surface 12 of the secondary pawl 7, lifting the secondary pawl 7 out of blocking engagement from the primary pawl 6, as shown in FIG. 4*a*).

Due to the opening tendency of the primary pawl 6, subsequently, the primary pawl 6 is driven into its lifting direction by the catch 3, which urges into its opening direction as noted above. In addition, the ongoing actuation of the actuation lever 8 leads to the secondary pawl 7 being driven further in its lifting direction, such that the driving surface 19 of the secondary pawl 7 drives the receiving surface 20 of the primary pawl 6, further lifting the primary pawl 6. As a result, the primary pawl 6 is free from the catch 3 until the actuation lever 8 is released to its initial position.

It may finally be pointed out, that any of the components catch 3, primary pawl 6, secondary pawl 7 and actuation lever 8 may be spring biased. The catch 3 may be spring-biased into its opening position, the primary pawl 6 may be spring-biased against its lifting direction, the secondary pawl 7 may be spring-biased against its lifting direction and the actuation lever 8 may be spring biased against its actuation direction.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

The invention claimed is:

1. A motor vehicle lock comprising:

a detent mechanism including:

a catch configured to pivot between an open position, a primary closed position, and a secondary closed position, wherein when the catch is in the secondary closed position, the catch is disposed between the open position and the primary closed position;

a pawl arrangement, wherein when the catch is in the secondary closed position and in the primary closed position, the pawl arrangement is in a blocking state, blocking the catch, and wherein when the pawl arrangement is in a release state, the catch may move to the open position, wherein the pawl arrangement includes a primary pawl and a secondary pawl, wherein when the pawl arrangement is in the blocking state, the primary pawl engages and blocks the catch, and the secondary pawl engages and blocks the primary pawl, wherein the secondary pawl is configured to move to disengage from the primary pawl, such that the primary pawl may move and disengage from the catch, thereby placing the pawl arrangement into the release state; and an actuation lever, wherein the actuation lever is configured to actuate to move the secondary pawl, wherein when the catch moves in a closing direction from the open position, the catch actuates the actuation lever to move the secondary pawl such that the secondary pawl does not block the primary pawl.

2. The motor vehicle lock of claim 1, wherein when the pawl arrangement is in the blocking state, a blocking surface of the secondary pawl engages a counter blocking surface of the primary pawl.

3. The motor vehicle lock of claim 1, wherein when the actuation lever is actuated to move the secondary pawl, a driving surface of the actuation lever engages a receiving surface of the secondary pawl to move the secondary pawl such that the secondary pawl moves the primary pawl.

4. The motor vehicle lock of claim 1, wherein the primary pawl includes a blocking surface, wherein when the pawl arrangement is in the blocking state and when the catch is in the primary closed position, the blocking surface of the primary pawl engages a primary counter blocking surface of the catch, and wherein when the catch is in the secondary closed position and when the pawl arrangement is in the blocking state, the blocking surface of the primary pawl engages a secondary counter blocking surface of the catch, and wherein the primary counter blocking surface is spaced apart from a pivot axis of the catch by a first distance and the secondary counter blocking surface spaced apart from the pivot axis of the catch by a second distance, wherein the first distance and the second distance are the same.

5. The motor vehicle lock of claim 4, wherein when the pawl arrangement is in the blocking state, a position of the primary pawl is the same when the catch is in the primary closed position and when the catch is in the secondary closed position.

6. The motor vehicle lock of claim 5, wherein the blocking surface of the primary pawl, a primary counter blocking surface of the catch, and the secondary counter blocking surface of the catch are each configured such that when the pawl arrangement is in the blocking state, the blocking surface of the primary pawl engages the primary counter blocking surface of the catch or the secondary counter blocking surface of the catch.

7. The motor vehicle lock of claim 6, further comprising an opening drive configured to operate in an opening sequence to actuate the actuation lever to move the secondary pawl, causing the primary pawl to move and be disengaged from the catch.

8. The motor vehicle lock of claim 7, wherein during the opening sequence, the opening drive actuates the actuation lever such that a driving surface of the actuation lever engages a receiving surface of the secondary pawl to move the secondary pawl to thereby lift the primary pawl, wherein the movement of the second pawl causes the driving surface of the secondary pawl to engage the receiving surface of the primary pawl and to lift and disengage the primary pawl from the catch.

9. The motor vehicle lock of claim 1, wherein when the catch moves in the closing direction from the secondary closed position, the catch actuates the actuation lever to move the secondary pawl relative to the primary pawl.

10. The motor vehicle lock of claim 9, wherein when the catch actuates the actuation lever to move the secondary pawl, a driving surface of the catch engages a receiving surface of the actuation lever.

11. The motor vehicle lock of claim 9, wherein the movement of the secondary pawl lifts the primary pawl such that the primary pawl disengages from the catch.

12. The motor vehicle lock of claim 11, wherein when the secondary pawl is moved by actuation of the actuation lever, a driving surface of the secondary pawl engages a receiving surface of the primary pawl to lift the primary pawl.

13. The motor vehicle lock of claim 1, wherein when the catch moves in the closing direction from the secondary closed position, the catch disengages the actuation lever before the catch reaches the primary closed position.

14. The motor vehicle lock of claim 1, wherein the primary pawl includes a receiving surface and a counter blocking surface and defines an indentation, wherein the indentation is jaw shaped, wherein the receiving surface and the counter blocking surface are each disposed on opposite sides of the indentation, and wherein when the primary pawl is lifted, a driving surface of the secondary pawl engages the indentation.

15. A motor vehicle lock comprising:

a detent mechanism including:

a catch configured to pivot between an open position, a primary closed position, and a secondary closed position, wherein when the catch is in the secondary closed position, the catch is disposed between the open position and the primary closed position;

a pawl arrangement, wherein when the pawl arrangement is in a blocking state, the pawl blocks the catch when the catch is either in the secondary closed position or in the primary closed position, and wherein when the pawl arrangement is in a release state, the catch may move to the open position, wherein the pawl arrangement includes a primary pawl and a secondary pawl, wherein when the pawl arrangement is in the blocking state, the primary pawl engages and blocks the catch, and the secondary pawl is configured to engage and block the primary pawl and move to lift the primary pawl, such that the primary pawl may lift and disengage from the catch, thereby placing the pawl arrangement into the release state; and an actuation lever, wherein the actuation lever is configured to actuate to lift the secondary pawl, wherein when the catch moves in a closing direction from the open position, the catch actuates the actuation lever to move the secondary pawl such that the secondary pawl lifts the primary pawl.

16. The motor vehicle lock of claim 15, wherein when the pawl arrangement is in the blocking state, a blocking surface of the secondary pawl engages a counter blocking surface of the primary pawl.

17. The motor vehicle lock of claim 15, wherein when the actuation lever actuates, a driving surface of the actuation lever engages a receiving surface of the secondary pawl to move the secondary pawl such that the secondary pawl lifts the primary pawl.

18. The motor vehicle lock of claim 15, wherein the primary pawl includes a blocking surface, wherein when the pawl arrangement is in the blocking state and when the catch is in the primary closed position, the blocking surface of the primary pawl engages a primary counter blocking surface of the catch, and wherein when the catch is in the secondary closed position and when the pawl arrangement is in the blocking state, the blocking surface of the primary pawl engages a secondary counter blocking surface of the catch, and wherein the primary counter blocking surface is spaced apart from a pivot axis of the catch by a first distance and the secondary counter blocking surface spaced apart from the pivot axis of the catch by a second distance, wherein the first distance and the second distance are the same.

19. The motor vehicle lock of claim 1, wherein when the catch moves in the closing direction by a predetermined-closing-movement distance from the secondary closed position, the actuation lever actuates such that the primary pawl is moved and disengages from the catch.

* * * * *